US007380297B2

(12) United States Patent
Bauer

(10) Patent No.: US 7,380,297 B2
(45) Date of Patent: Jun. 3, 2008

(54) FITTED BED TOP COVERINGS

(76) Inventor: Dennis E. Bauer, 1703 Milholland Dr., Spring, TX (US) 77386

( * ) Notice: Subject to any disclaimer, the term of this patent is extended or adjusted under 35 U.S.C. 154(b) by 15 days.

(21) Appl. No.: 11/325,041

(22) Filed: Jan. 4, 2006

(65) Prior Publication Data

US 2007/0151028 A1 Jul. 5, 2007

(51) Int. Cl.
*A47G 9/04* (2006.01)

(52) U.S. Cl. ..... 5/497; 5/499; 5/482

(58) Field of Classification Search ..... 5/482, 5/497, 499

See application file for complete search history.

(56) References Cited

U.S. PATENT DOCUMENTS

| | | | | |
|---|---|---|---|---|
| 2,612,646 | A * | 10/1952 | Sussman | 5/499 |
| 3,321,782 | A * | 5/1967 | Hrubecky et al. | 5/487 |
| 3,824,640 | A * | 7/1974 | Golden | 5/485 |
| 4,045,831 | A | 9/1977 | Clark | |
| 4,245,365 | A * | 1/1981 | Large | 5/496 |
| 4,308,626 | A | 1/1982 | Weiss | |
| 4,651,371 | A * | 3/1987 | Hahn | 5/497 |
| 5,165,128 | A | 11/1992 | Honig | |
| 5,177,821 | A | 1/1993 | Kawtoski | |
| 5,375,274 | A | 12/1994 | Cuneo | |
| 5,442,822 | A * | 8/1995 | Diaz | 5/497 |
| 6,108,836 | A | 8/2000 | Keene, III | |
| 6,725,477 | B2 | 4/2004 | Ciaglia et al. | |
| 2004/0200000 | A1* | 10/2004 | Harbin et al. | 5/497 |
| 2006/0168726 | A1* | 8/2006 | Cushing | 5/497 |

OTHER PUBLICATIONS

Double Dream® brand of bed sheets offered by Bedmaid Corporation on the worldwide web through the website of Sheets2Love.com. (1 page excerpt from this website). Applicant believes that this product may be related to the product disclosed in Ciaglia, et al. (Reference AB above). Date printed = Sep. 17, 2005.

* cited by examiner

*Primary Examiner*—Patricia Engle
*Assistant Examiner*—Bill Kelleher
(74) *Attorney, Agent, or Firm*—Gordon G. Waggett, P.C.

(57) ABSTRACT

The present invention is directed generally to bed coverings for a mattress and, more particularly, to a fitted (or semi-fitted) top sheet that may be attached at one end to the mattress and which may be placed between a user and other bedding such as blankets, quilts, comforters, or the like. The fitted sheet provides for ease in changing or making the bed. The fitted bed sheet of the present invention includes a zone of expansion to provide extra room for a sleeper's feet, and provides overhanging side flaps to provide and end-to-end finished look. Additionally, the present invention is directed to a fitted blanket, fitted quilt, fitted comforter and fitted bedspread for a mattress. The invention is also directed to a pattern for making these fitted bed coverings from an existing flat sheet or a starting flat cloth.

10 Claims, 5 Drawing Sheets

FITTED BED TOP COVERINGS

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

The present invention is directed generally to bed coverings for a mattress and, more particularly, to a fitted (or semi-fitted) top sheet that may be attached at one end to the mattress and which may be placed between a user and other bedding such as blankets, quilts, comforters, or the like. Additionally, the present invention is directed to a fitted blanket, fitted quilt, fitted comforter and fitted bedspread for a mattress. The invention is also directed to a pattern for making these fitted bed coverings.

BACKGROUND ART

Conventional bed sheets are presently available in two basic varieties; namely, a fitted bottom sheet, and a flat top sheet. Likewise, conventional blankets, quilts, comforters and bedspreads are created as a flat cloth that is draped over the mattress and tucked in if desired. These bed coverings are manufactured in a multitude of sizes to accommodate the various mattress sizes, such as twin, full, queen, king, "California King", mattress depths, including standard and "pillow top", and various mattress types, such as those used in beds at home, or those used in hotels, hospitals, barracks, and other commercial or governmental settings requiring beds. Custom bed coverings size can also exist, such as, for example those customized to fit specialized mattresses such as mattresses utilized in trucks, campers, recreational vehicles, sofa beds, children's beds, cribs, bassinets, irregularly-shaped mattresses or the like. Although many mattress sizes are standardized, the precise dimensions of a standardized mattress may vary slightly from manufacturer to manufacturer.

The changing of bed coverings is often regarded as a "chore" by those desiring to, e.g., change the sheets on their beds at home, or by those employed to change bed linens, such as, in hotels and hospitals. As such, improvements are sought to make life easier when it comes to changing a bed—at home this can translate to more time for other activities, and in a commercial setting, can translate to the saving of time and money spent in servicing the bed linens.

It has also been stated previously that after making a bed in the usual manner certain difficulties are encountered. The most annoying difficulty is that often the bottom portion of the top bed sheet will be kicked loose from the mattress by a restless sleeper at a time that is not conducive to remaking the bed, thereby causing chill and discomfort to the sleeper(s).

A great deal of time is expended by an individual who must remake the entire bed due to the loosening of the top sheet only. For as the top sheet is kicked free, so too are the bed coverlets above it loosened. Depending upon the number of coverlets above the sheet, (an average of three in the winter, two blankets and a spread), it will take a minimum of ten minutes per day to remake an entire queen-sized bed.

That means one (1) hour and ten (10) minutes per week, or sixty-one (61) hours per year to make just one bed. For a family of four members, daily bed making could take as much time as two hundred forty four (244) hours per year. In settings other than the home, such as a hotel, the collective time to make such beds, or change such beds can be significant.

The most common sheet configuration in use on beds today is the use of a fitted sheet to cover the mattress, with a flat sheet used as an upper sheet. Fitted sheets usually have an elastic strip at each corner or a single continuous strip surrounding the open edge of the sheet.

Typically, a top or flat sheet is placed over the fitted bottom sheet between the user and other bedding such as blankets, quilts, comforters, and the like. The top sheet may be tucked beneath the foot end of the mattress when the bed is made. However, top sheets frequently become loose from under the mattress during use, and are inconvenient to tuck in and refold when the bed is again made. Known to the art are bed clothes, made for use with waterbeds, which include a top sheet having a portion of the lower edge attached to a lower end of the fitted sheet. This method of attaching the top sheet to the fitted sheet eliminates many of the problems associated with loose top sheets. However, it fails to address the inconvenience of refolding the top sheet at the lower corner to provide a finished appearance should the waterbed sheet be utilized with a conventional mattress.

Fitted bottom sheets are known including an overhang which overhangs the sides of a mattress and is drawn inwardly under the mattress by elastic strips so that the bottom sheet is tightly spread over the top of the mattress and held securely in place. When a separate flat top sheet is used with the fitted bottom sheet, it must be carefully adjusted and tucked in with hospital corners, and even then the top sheet comes untucked readily. This makes making up the bed an unnecessarily complicated procedure for everyone, and a potentially difficult procedure for those with vision problems or other physical difficulties.

Fitted top sheets are also known having the same type of fitting at the bottom as the fitted bottom sheets, particularly with satin sheets, but this construction leaves little room at the bottom for the sleeper's feet.

It is even known to have a combination of a fitted bottom sheet with an attached top sheet. However, the known constructions for such combinations either provide too little space for the sleeper's feet and/or require complicated constructions that are relatively expensive and difficult to handle when making up the bed.

For example, U.S. Pat. No. 6,108,836 to Keene, III, describes bed clothes having a fitted bottom sheet and an attached top sheet. The bottom sheet may form head and foot end pockets which envelop, respectively, the head and foot ends of the mattress, wherein the head end pocket extends along the bottom surface of the mattress from the head end for a length less than or equal to the thickness of the mattress (as measured between the top surface and the bottom surface of the mattress) and the foot end pocket extends along the bottom surface from the foot end for a length at least as great as one and one half times this thickness. The top sheet is attached to the foot end pocket of the bottom sheet so that a user's feet may extend past the foot end of the mattress without substantially displacing the top sheet in a direction generally from the head end to the foot end of the mattress.

Fitted sheets are preferred over flat sheets because they may be quickly and neatly placed on a mattress without tedious folding and manipulation of the sheet's corners. Further, fitted sheets provide a convenient means for retaining the sheet on the mattress during use. Typically, prior art fitted sheets may be categorized as one of three types.

Perhaps the most commonly used type of fitted sheet comprises an elastic band attached along the ends of the sheet to draw the sheet closed about the sides of a mattress. These elastic bands may, however, be subject to wear after repeated use and may allow the sheet to come loose from the mattress as a user lying thereon changes positions.

A second type of fitted sheet employs generally triangular shaped panels sewn to each corner of the sheet to form corner pockets which hold the corners of the mattress. This type of sheet is most commonly utilized with waterbed mattresses, wherein the corner of the waterbed mattress may be lifted slightly to permit its insertion within the corner pocket. However, such corner pockets typically do not fit well on conventional mattresses and thus may also allow the sheet to come loose from the mattress.

U.S. Pat. No. 5,375,274 to Cuneo discloses a third type of fitted sheet. This sheet utilizes head and foot end pockets which hold, respectively, the head and foot ends of the mattress. However, both the head and foot end pockets of the Cuneo bottom sheet have a depth at least as great as the thickness of the mattress in order to securely retain the sheet on the mattress. Consequently, if the depth of the pockets is too great, the sheet may be somewhat difficult to place on or remove from the mattress especially if the mattress is utilized in confined areas such as a truck cabin, camper, or recreational vehicle, or, alternatively, if the depth of the pockets is too shallow, the sheet may slip off the mattress during use.

Cuneo, supra, also teaches bed clothes for a mattress wherein the top sheet is attached to the bottom sheet. However, because the top sheet of the Cuneo bed clothes is attached to the bottom sheet along the top surface of the mattress, users may find that they cannot extend their feet past the end of the mattress without substantially displacing the top sheet in a direction generally from the head end to the foot end of the mattress. This limitation may prove uncomfortable to many persons who prefer sleeping with their feet extending over the end of the mattress.

Furthermore, in U.S. Pat. No. 4,045,831 to Clark, there is described a bed sheet which can be used both as a bottom and top sheet. The bed sheet has a fabric panel sized to fit the mattress with which it is to be used. Open pockets at each end of the bed sheet serve to enclose the head and foot portions of a mattress when used as a bottom sheet. When used as a top sheet, one pocket is used to enclose the foot portion of a mattress while the second pocket is used to hold the edge of a blanket from contact with a person while sleeping.

U.S. Pat. No. 5,177,821 to Kawtoski describes a bed sheet combination, including a fitted bed sheet that is a rectangular interlocked cotton knitted fabric, wherein each corner of the rectangle is rounded and an elastic member is sewn around the periphery of the sheet to bunch up the corners, and a top sheet made of the same material, cut at the corners of one transverse side and an elastic member is attached to the transverse side and up a portion of the longitudinal sides extending therefrom, thus creating a billowy area at the bottom of the sheet to loosely receive feet.

U.S. Patent Application No. 20040200000 A1 to Harbin et al. discloses a top sheet having a fitted foot end and method of assembling a fitted sheet to a mattress are disclosed. The foot pocket has a foot end face panel that extends over a foot end of the mattress and a foot tuck panel that is tucked beneath the bottom surface of the mattress. The foot pocket further comprises right and left side corner panels that adjoin to both the foot end face panel and a top portion of the sheet to define a three sided corner that locates the sheet on the foot end of the mattress. According to the method, the top sheet is spread over the mattress with the right and left side corners located on the right and left top corners of the foot end of the mattress and a foot tuck panel is tucked under the mattress to secure the sheet to the mattress.

U.S. Pat. No. 6,725,477 to Ciaglia et al. describes a fitted sheets combination that includes a fitted bottom sheet and a top sheet. The bottom corners of the top sheet are formed of a widthwise cut edge and a lengthwise cut edge meeting at an angle of more than 90 degrees, and being attached to each other along respective lengths. The bottom corners of the top sheet are attached to the bottom corners of the bottom sheet to form a foot pocket at a bottom area of the combination. These sheets are commercially available from Bedmaid Corporation under the Double Dreams® brand as offered on the worldwide web through the website of Sheets2Love.com.

U.S. Pat. No. 4,308,626 to Weiss describes a fitted top sheet that includes a construction which provides a foot accommodating space when placed in position on a mattress. The sheet has a one piece construction wherein the fitted bottom corners and foot accommodating space are formed by sewing the cut edges of two cut-outs in each side of a generally rectangular piece of material.

Honig, U.S. Pat. No. 5,165,128, describes a fitted top sheet of a generally rectangular blank of fabric material having two bottom corners, each corner cut away by three curved lines to form a junction having an angle of substantially 90 degrees, to each of which a band of stretchable material is sewn, in stretched condition, to the outside edge of the cut corners and along the entire edge portion of the bottom of the blank, which cut corners are then joined by stitching at each corner and bottom edges thereof, thereby forming two expandable pockets for engaging the bottom corners and bottom portion of a mattress.

The previous art has laid claim to simplicity. Most, however, have complicated the process by adding snaps, zippers, buttons, hooks and eyes, VELCRO® hook and loop fasteners, stretchable materials not commercially available, or by the use of complicated fabric cutting processes. The latter require expensive manufacturing details as well as time consuming fussing for the bed-maker. The focus has remained on providing sufficient excess fabric material in the sheet for covering the feet without solving the problem of easing the burden of the daily task of remaking the bed for the bed-maker.

Manufacturers have provided us with fitted bottom sheets, but they have not taken the next step in providing a simple, yet effective, fitted top bed sheet, which enables the bed-makers to complete their tasks in a faster, easier manner, while also providing the sleeper with a zone of expansion at the foot end to provide the sleeper with more foot room. What is desired is to have a fitted top sheet that can readily be placed on the mattress (e.g., over the bottom sheet) while also allowing the top sheet to maintain a square-cornered look and allow for a desired overhang, or drape, along the entire length of the mattress that is even on both sides. It would also be desired that such fitted top sheet provide the user with a comfortable, expandable area for the user's feet. These characteristics would likewise be desirable on a blanket, comforter, quilt, and/or bedspread used on the bed. It is to this issue that this invention is directed.

BRIEF SUMMARY OF THE INVENTION

To address the forgoing problems, the present invention teaches a partially fitted bed covering comprising a fabric sheet having a head end (at the end of a bed where the sleeper's head typically resides) and a foot end (where the sleeper's feet are normally located) opposing the head end. The sheet also has a right side edge and a left side edge opposite the right side edge. The head end is separated from the foot end by a desired length (L); the left side edge is separated from the right side edge by a desired overall width (W). The fitted sheet includes an expandable, five-sided pocket fixably attached and centered along a portion of the width (W) of the underside of the foot end of the fabric sheet. The pocket contains an opening facing toward the head end of the sheet and is sized to be capable of receiving the foot end of a desired mattress. The pocket opening has a bottom edge, opposed side edges and a top edge. The width (W) of the sheet, when placed on the mattress, is sufficient to substantially cover the sides of the mattress and to cover the opposed side edges of pocket opening. The sheet also has a zone of expansion created in said foot end of said sheet by increasing the size of said opening relative to the size of said foot end of said mattress. In a preferred embodiment, the partially fitted bed covering is constructed from a single piece of fabric. In another preferred embodiment, the partially fitted bed covering further comprises an elastic material around the opening of said pocket. The partially fitted bed covering may be a top sheet, blanket, quilt, bed spread, comforter or other bed covering.

In another preferred embodiment, the partially fitted bed covering pocket opening is defined by two opposed side panels, an underside panel, a back panel and a top panel. In one preferred embodiment, the opposed side panels are preferably in the shape of a rectangle, while in another preferred embodiment, the opposed side panels are in the shape of a trapezoid, while in yet another preferred embodiment, the opposed side panels are in the shape of a parallelogram.

In another preferred embodiment, there is described a fitted bed covering comprising a fabric sheet having a head end and a foot end opposing the head end, a right side edge and a left side edge opposite the right side edge. The head end is preferably separated from the foot end by a desired length (L); the left side edge is separated from the right side edge by a desired overall width (W). The sheet includes an expandable, five-sided pocket located on the underside of the foot end of the fabric sheet. The pocket preferably comprises a back face, an underside flap, a right side expansion flap, a left side expansion flap, and a portion of the underside of said fabric sheet. In a preferred embodiment, the back face has a foot end top edge centered and contiguous with a portion (W') of the width (W) of the fabric sheet foot end; a foot end bottom edge substantially parallel to, opposite and separated by depth (D') from the foot end top edge; a back face right edge of depth (D') and a back face left edge of depth (D') opposite and parallel to the back face right edge; the back face existing in a plane substantially perpendicular to the fabric sheet. In this embodiment, the depth (D') represents the depth of a mattress to be covered with the fitted bed covering.

Preferably, the right side expansion flap has a top edge fixably attached to the underside of the fabric sheet parallel to and disposed from the right side edge; a bottom edge opposite the top edge, a left edge that is contiguous with the back face right edge, and a right side outer edge opposite the left edge. The left side expansion flap preferably has a top edge fixably attached to the underside of the fabric sheet parallel to and disposed from the left side edge; a bottom edge opposite the top edge, a right edge that is contiguous with the back face left edge, and a left side outer edge opposite the right edge. The underside flap preferably has a foot end edge contiguous with the back face foot end bottom edge; a head end edge opposite the foot end edge; a right side edge contiguous with the right side expansion flap bottom edge; and a left side edge contiguous with the left side expansion flap bottom edge.

The pocket preferably has an opening capable of receiving the foot end of a mattress defined by the right side expansion flap right side outer edge, the left side expansion flap left side outer edge, the underside flap head end edge, and the underside of the fabric sheet. The width (W) of the sheet, when placed on said mattress, preferably is sufficient to substantially cover the sides of the mattress and to substantially cover the right side expansion flap and the left side expansion flap. The sheet also employs a zone of expansion created in the foot end of the sheet by increasing the size of the opening relative to the size of the foot end of said mattress.

In this embodiment, the fitted bed covering preferably is constructed from a single piece of fabric. Further, the fitted bed covering comprises an elastic material around the opening of the pocket. This embodiment can likewise be employed as a top sheet, blanket, quilt, bed spread or comforter. In one preferred embodiment, the right side expansion flap and the left side expansion flap are in the shape of a rectangle; in another, the right side expansion flap and the left side expansion flap are in the shape of a trapezoid; in yet another, the right side expansion flap and the left side expansion flap are in the shape of a parallelogram. In one preferred embodiment, the right side expansion flap left edge meets the right side expansion flap bottom edge at an angle greater than or equal to 90 degrees, and the left side expansion flap right edge meets the left side expansion flap bottom edge at an angle greater than or equal to 90 degrees. In yet another preferred embodiment, the length of the right side expansion flap right edge and the left side expansion flap left edge are equal to 1.25×(D').

DETAILED DESCRIPTION OF THE INVENTION

Reference is now made to the drawings which depict preferred embodiments of the present invention, but are not drawn to scale. Referring now to FIGS. 1*a*, 1*b*, 1*c*, 1*d* and 1*e*, there are shown, from top view, a blank or patterned cloth 100 from which a fitted bed covering can be sewn according to preferred embodiments of the present invention. In a preferred embodiment, the fitted (or partially fitted) bed covering is a fitted top sheet. A partially fitted top sheet as disclosed can be made to fit any bed or mattress size such as a twin, full, queen or king size mattress and may be used with a mattress and box spring set or platform bed. This unique design for a top sheet may be strategically cut from flat material and simply sewn. The unique design can be manufactured from the same size fabric blank as a conventional flat top sheet and can be manufactured from a commercially available standard flat top sheet. Only a minimum additional amount of labor is required to manufacture the unique partially fitted top sheet of the present invention when compared to the labor required to manufacture a conventional flat top sheet.

According to one aspect of the present invention, a partially fitted top sheet for a mattress is provided. As such, the following illustrations will describe a partially fitted top sheet, but could be adapted for use in constructing other partially fitted bed coverings, such as, a fitted blanket, fitted quilt, fitted comforter and fitted bedspread. As used herein, the terms right and left refer to the sides of the bed when viewed from the foot of the bed. Additionally, it is preferred that the fitted top sheet be substantially symmetrical between its right and left sides so that the left side is substantially the mirror image of the right side and visa versa.

Figure 1A:
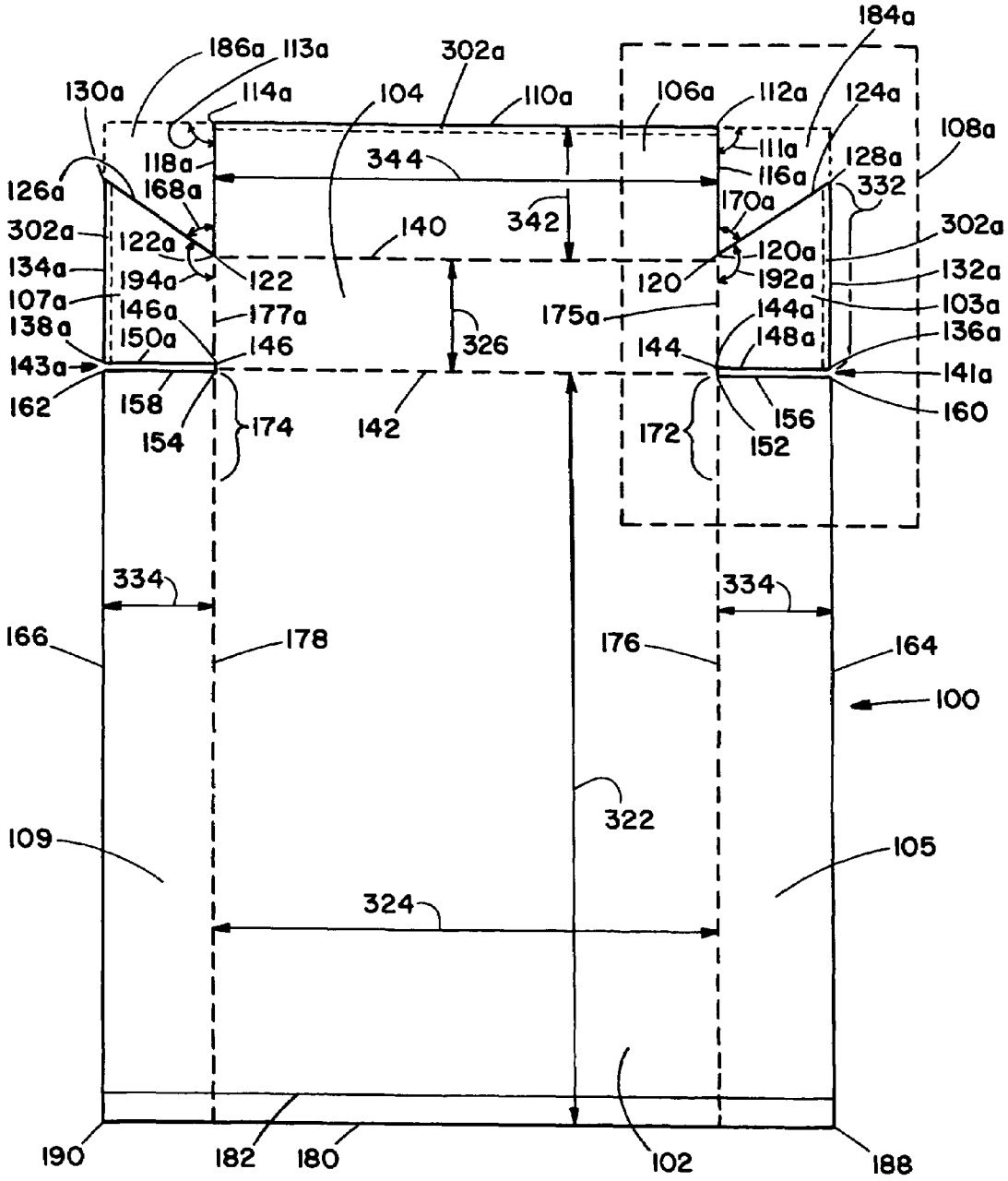
FIG. 1*a* shows a plan view of a patterned cloth ready for construction into a fitted top bed sheet according to a preferred embodiment of the present invention. The outlined area illustrates the zone or area of patterning in the upper right corner which is preferably a mirror image of the patterning in the upper left corner.

FIG. 1*a* depicts a top sheet pattern (or patterned cloth) 100 that can be employed in creating preferred partially fitted bed clothes of the present invention. Similarly, FIGS. 1*b*-1*e* depict additional top sheet patterns 100 that can be employed in creating other preferred partially fitted bed clothes of the present invention. As will be seen, each of these embodiments (FIGS. 1*a*-1*e*) share some attributes and as such, will employ the same numbering system except in the area of the pattern master zone 108*a* shown in FIG. 1*a*. The different features of the other embodiments (FIGS. 1*b*-1*e*) occur within the pattern master zone 108*a*, and will be described and numbered separately, it being understood that the embodiments shown in FIGS. 1*b*-1*e* preferably include the attributes shown on FIG. 1*a* outside of the area of pattern master zone 108*a* even though such attributes are not shown in FIGS. 1*b*-1*e*.

Referring again to FIG. 1*a* (also considered with respect to FIGS. 1*b*-1*e*), the top sheet pattern 100 has a top side face 102 which, when the sheet is constructed, would fit substantially on the top face of a desired mattress (M) having a length (L) (i.e., measured head end to foot end), a width (W) (measured left to right) and a depth (D). The top side face 102, in this embodiment, is substantially rectangular in shape (to correspond with a substantially rectangular-shaped mattress), and is defined generally by head end edge 180; foot end top edge 142 parallel to the head end edge 180 and separated from the head end edge 180 by length (L') 332; right and left side fold lines 176, 178, which are parallel to each other and separated by width (W') 324; where width (W') and length (L') correspond with the approximate top face dimensions of the desired mattress (M) to be used with a fitted top sheet of the present invention. It will be appreciated that the measurements of length (L), width (W), and depth (D) will depend on the particular mattress configuration, be it standard-sized or custom-sized. Additionally, it is preferred that the top sheet pattern be substantially symmetrical between its right and left sides so that the left side of the pattern is substantially the mirror image of the right side of the pattern and visa versa.

The patterned cloth 100 has a left side flap 105, a right side flap 109, both of width ($W_f$) 334 and length (L'), the width ($W_f$) 334 being the desired overhang of the top sheet over the side of the mattress (M) from fold lines 176, 178; the length (L') being a desired length relative to the length (L) of the mattress (M). In a preferred embodiment, length (L') of the pattern is at least as long as the mattress length (L), and in another preferred embodiment, contains sufficient length to allow the top sheet to be folded back a desired amount over, e.g., other bed coverings, such as a blanket. Some standard mattress dimensions are reported as follows:

TABLE 1

Standard Mattress Dimensions (Inches)

| Size | Width (W) | Length (L) | Depth (D) |
|---|---|---|---|
| Twin | 38 | 75 | 6-8 |
| Full | 54 | 75 | 6-8 |
| Queen | 60 | 80 | 6-8 |
| King | 76 | 80 | 6-8 |
| California King | 72 | 84 | 6-8 |

The left side flap 105 shares at the head end of the bed the left-most portion (of width ($W_f$)) of head end edge 180, and has at the foot end of the bed opposite this portion of the head end edge 180 a left side flap bottom edge 156 also of length ($W_f$) extending axially outward from the foot end top edge 142 from foot end left side flap right corner 152 to foot end left side flap left corner 160. The left side flap 105 has as its outer edge left side flap edge 164 having length (L') as defined by the distance between foot end left side flap left corner 160 and left head end corner 188. The left side flap 105 also shares with sheet top side face 102 left fold line 176 also of length (L') indicating where the sheet, once formed, would begin draping over the edge of the mattress (M). Left fold line 176 is parallel to and separated by width ($W_f$) from left side flap edge 164. Left side flap 105 is substantially rectangular in shape in this embodiment.

Similarly, the right side flap 109 shares at the head end of the bed the right-most portion (of width ($W_f$)) of head end edge 180, and has at the foot end of the bed opposite this portion of the head end edge 180, a right side flap bottom edge 158 also of length ($W_f$) extending axially outward from the foot end top edge 142 from foot end right side flap left corner 154 to foot end right side flap right corner 162. The right side flap 109 has as its outer edge right side flap edge 166 having length (L') as defined by the distance between foot end right side flap right corner 162 and foot end right side flap left corner 154. The right side flap 109 also shares with sheet top side face 102 right fold line 178 also of length (L') indicating where the sheet, once formed, would begin draping over the edge of the mattress (M). Right fold line 178 is parallel to and separated by width ($W_f$) from right side flap edge 166. Right side flap 109 is substantially rectangular in shape in this embodiment.

The pattern 100 has a head end edge 180 (with indications of the location of a finishing hem 182) and left and right corners 188, 190, respectively. The pattern also has a foot end top edge 142 defining where the top sheet, when constructed, would meet the foot end top edge of the mattress (M), and a foot end bottom edge 140 defining where the top sheet, when constructed, would meet the foot end bottom edge of the mattress (M). The spacing or depth (D') between the foot end bottom edge 140 and the foot end top edge 142 is preferably the depth (D) of the desired mattress (M). The spacing (W') between left and right fold lines 176, 178 is preferably the width (W) of the desired mattress (M). The total width of the patterned cloth (and hence the fitted top sheet made therefrom) equals $2(W_f)+(W')$.

The patterned sheet 100 also has a back face 104 having depth (D') and width (W'), substantially corresponding in size with the foot end edge of the mattress (M) (not shown), and having substantially a rectangular shape. Back face depth (D') preferably is about the same depth as mattress depth (D). The back face 104 has a top left corner 144, a bottom left corner 120, a top right corner 146, and a bottom right corner 122. The distance between corners 144 and 120 is preferably equal to D'. The distance between corners 146 and 122 is preferably equal to D'. The distance between corners 146 and 144 is preferably equal to W'. The distance between corners 122 and 120 is preferably equal to W'.

Referring to FIG. 1*a*, the patterned cloth 100 includes a pattern master zone 108*a* containing an exemplary pattern for creating a fitted top sheet according to a preferred embodiment of the present invention. As will be understood, the pattern master zone 108*a* is shown illustrating the left side, foot end of the patterned cloth. The pattern master zone 108*a* contains various desired patterning that can be used in transferring the pattern onto a flat piece of cloth or existing flat sheet used in creating a fitted flat sheet of the present invention. A pattern (not shown) can be created bearing the markings contained in pattern master zone 108*a* with conventional pattern paper (or other suitable material) so that the pattern, for each desired sheet size, can be used to mark the starting cloth material prior to sewing. The pattern itself could be designed so that, e.g., one needs only to line up the underside edge 110*a* and the left flap edge 164 of the pattern with the corresponding edges of the starting cloth (not shown) so that the pattern can then be transferred onto the starter cloth, such as, by tracing, marking with pattern pen, pinning, etc. It will also be understood that the same pattern, flipped over in mirror image fashion, could be used for transferring the pattern to the mirror image edges on the right side, foot end corner area of the starter cloth. Additionally, separate patterns could be created for the right and left side of the starter cloth. Although not as practical, a pattern covering both the right and left side portions of the starter cloth, or even the entire cloth could be employed. With knowledge of the teachings depicted herein, those of ordinary skill in the art could create and employ patterns for use in creating the various embodiments of fitted bed clothing of this invention.

In the construction of a preferred embodiment of the fitted top sheet of the present invention, the patterned sheet 100 contains left and right side expansion flaps 103*a*, 107*a* (FIG. 1*a*), respectively. In the embodiment of FIG. 1*a*, the side expansion flaps 103*a*, 107*a* are of a substantially trapezoidal shape. Left side expansion flap 103*a* has a left side expansion flap outer edge 132*a* (i.e., the base of the trapezoid) of a length ($L_m$) that is substantially axially aligned with pattern left flap edge 164 (however, the outer edge 132*a* could vary in its proximity to flap edge 164). The head end side of the left side expansion flap 103*a* has a left side expansion flap top edge 148*a* (which, in a preferred embodiment can be of width ($W_f$) or less to accommodate adjustments in the pocket size, such as differing lengths of $L_f$) which is substantially parallel to left side flap bottom edge 156. Left side expansion flap top left corner 136*a* forms a substantially 90 degree angle at the intersection of left side expansion flap outer edge 132*a* with left side expansion flap top edge 148*a*. In a preferred embodiment, the width of left side expansion flap top edge 148*a* is equal to ($W_f$), the distance between left side expansion flap top left corner 136*a* and left side expansion flap top right corner 144*a* (the same point also referred to earlier as back face top left corner 144) or less than ($W_f$) to accommodate adjustments in the pocket size, such as differing lengths of $L_f$. The length ($L_m$) of left side expansion flap outer edge 132*a* extends between left side expansion flap top left corner 136*a* and left side expansion flap cut point 128*a*. Opposite left side expansion flap top edge 148*a* is left side expansion flap bottom edge 124*a*. Left side expansion flap bottom edge 124*a* has a length defined as the distance between left side expansion flap cut point 128*a* and left side expansion flap bottom right corner 120*a* (the same point also referred to earlier as back face bottom left corner 120). The distance of left side expansion flap fold line (or back face left side edge) 175*a* between left side expansion top right corner 144*a* and left side expansion flap bottom right corner 120*a* along fold line 176 is distance (D').

Similarly, in mirror image fashion, right side expansion flap 107*a* has a right side expansion flap outer edge 134*a* (i.e., the base of the trapezoid) of a length ($L_m$) that is substantially axial with pattern right flap edge 166. The head end side of the right side expansion flap 107*a* has a right side expansion flap top edge 150*a* (which, in a preferred embodiment can be of width ($W_f$) or less to accommodate adjustments in the pocket size, such as differing lengths of $L_f$), which is substantially parallel to right side flap bottom edge 158. Right side expansion flap top right corner 138*a* forms a substantially 90 degree angle at the intersection of right side expansion flap outer edge 134*a* with right side expansion flap top edge 150*a*. In a preferred embodiment, the width of right side expansion flap top edge 150*a* can be equal to ($W_f$), the distance between right side expansion flap top right corner 138*a* and right side expansion flap top left corner 146*a* (the same point also referred to earlier as back face top right corner 146), or can be less than $W_f$ to accommodate adjustments in the pocket size, such as differing lengths of $L_f$. The length ($L_m$) of right side expansion flap outer edge 134*a* extends between right side expansion flap top right corner 138*a* and right side expansion flap cut point 130*a*. Opposite right side expansion flap top edge 150*a* is right side expansion flap bottom edge 126*a*. Right side expansion flap bottom edge 126*a* has a length defined as the distance between right side expansion flap cut point 130*a* and right side expansion flap bottom left corner 122*a* (the same point also referred to earlier as back face bottom right corner 122). The distance of right side expansion flap fold line (or back face right side edge) 177*a* between right side expansion top left corner 146*a* and right side expansion flap bottom left corner 122*a* along fold line 178 is distance (D').

Referring still to FIG. 1*a*, there is shown an underside flap 106*a* having an underside flap bottom edge 110*a* of width (W") (located opposite the head end edge 180) and parallel with foot end bottom edge 140. The underside flap 106*a* contains right and left underside edges 116*a*, 118*a*, respectively which are opposite and substantially parallel to each other. Forming the intersection of right and left underside edges 116*a*, 118*a*, with the respective right and left ends of underside flap bottom edge 110*a* at substantially 90 degree underside flap bottom edge angles (111*a*, 113*a*) are right and left corners, 112*a*, 114*a*, respectively. Underside flap bottom edge 110*a* is substantially parallel to and separated by length ($L_f$) from foot end bottom edge 140. Underside flap 106*a* has a length ($L_f$) that is defined as the desired length of top sheet to be tucked under the back edge of the mattress M. The total length of the pattern, and hence the fabric used to make the fitted bottom sheet is (L')+(D')+($L_f$). In the preferred embodiment depicted in FIG. 1*a*, underside flap 106*a* is a substantially rectangular shape defined by edges 110*a*, 140, 116*a*, and 118*a*. In this embodiment, underside flap left edge 116*a* has length equal to ($L_f$) as defined by the distance between underside edge left corner 112*a* and back face bottom left corner 120. In the embodiment of FIG. 1*a*, width (W")=width (W'). At the intersection of left and right underside edges 116*a* and 118*a*, respectively, with left and right side expansion flap bottom edges 124*a* and 126*a*, respectively, there are formed left and right expansion angles, 170*a*, 168*a*, respectively. In the preferred embodiment of FIG. 1*a*, left and right expansion angles are substantially equal and are both less than 90 degrees. In a preferred embodiment, length ($L_m$) of right and left side expansion flap outer edges 134*a*, 132*a*, respectively, is calculated to result in the lengths of right and left underside edges 116*a*, 118*a* and right and left side expansion flap bottom edges 126*a*, 124*a* being substantially equal. When the fitted top sheet is constructed from this pattern 100, the underside flap 106*a* will lay beneath the foot end of the mattress (M).

Additionally, with reference to FIG. 1*a*, there are shown left and right side seam lines 172, 174, respectively, indicating where, in the case of FIGS. 1*a*-1*d*, the respective left and right side expansion flap top edges will be sewn in creating preferred fitted bed clothes according to the present invention.

Also, as discussed later in conjunction with FIGS. 1*a*-1*e* and FIGS. 2-3, there is shown a zone for receiving an elastic material 302*a*-*e*.

Figure 1C:
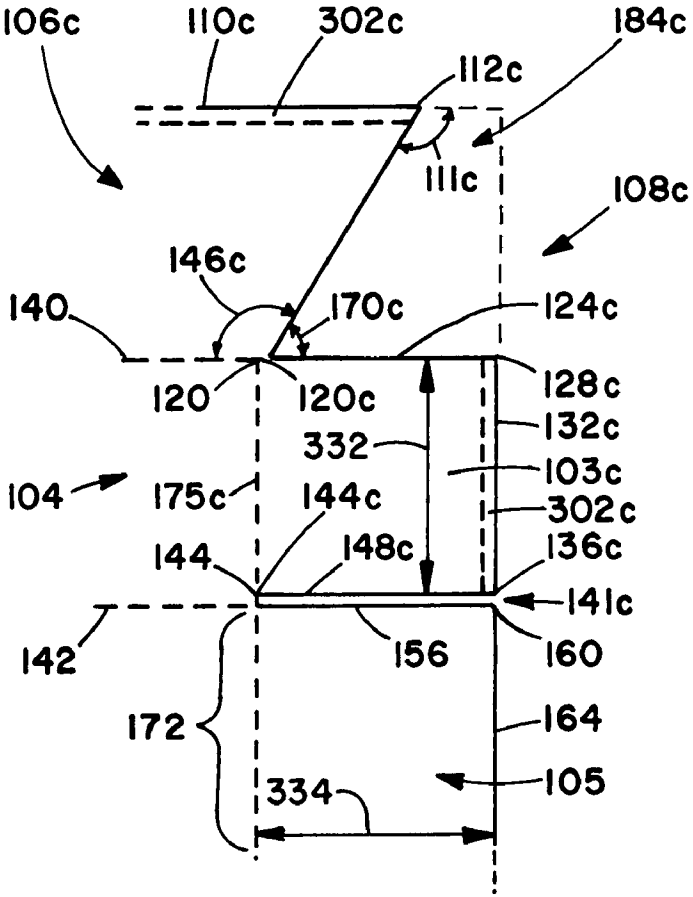
FIG. 1*c* shows a plan view of an alternative patterning to the cloth in the outlined area in FIG. 1*a* used for making a fitted top bed sheet according to another preferred embodiment of the present invention.
Figure 1B:
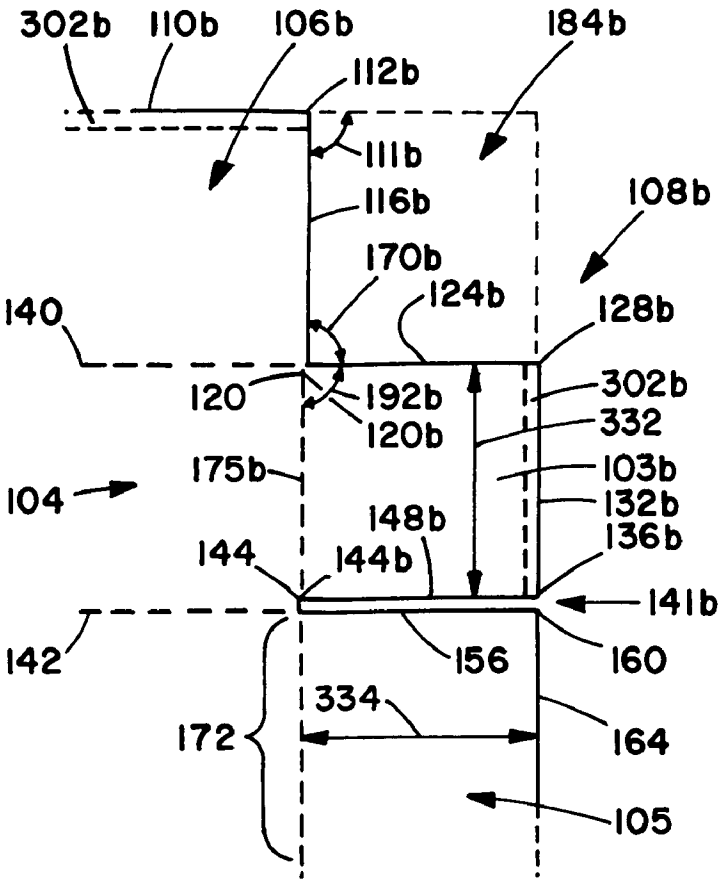
FIG. 1*b* shows a plan view of an alternative patterning to the cloth in the outlined area in FIG. 1*a* used for making a fitted top bed sheet according to another preferred embodiment of the present invention.
Figure 1E:
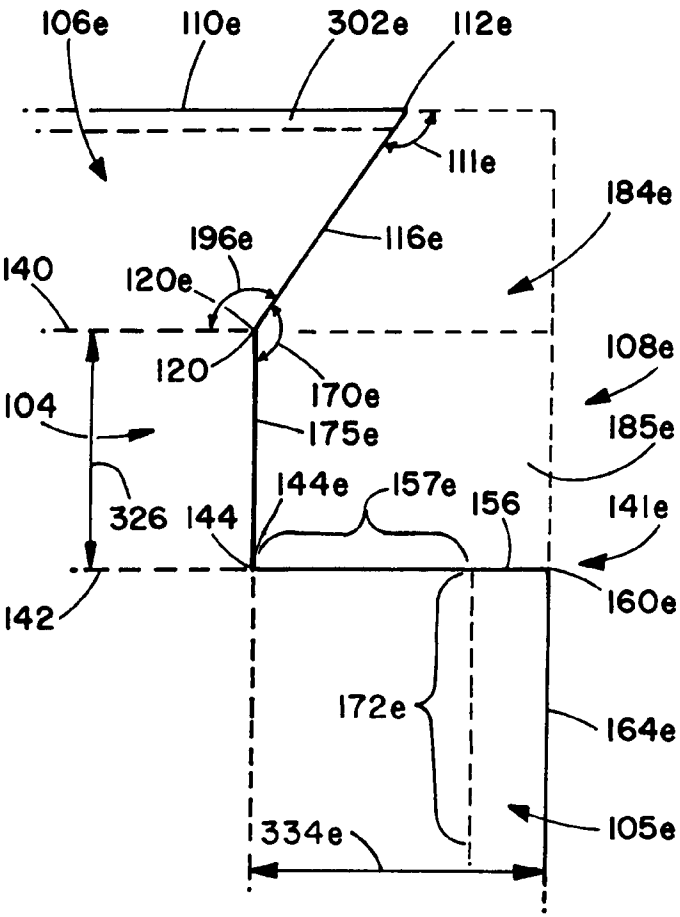
FIG. 1*e* shows a plan view of an alternative patterning to the cloth in the outlined area in FIG. 1*a* used for making a fitted top bed sheet according to another preferred embodiment of the present invention.

As described above, the patterned cloth 100 could have originated with a flat, rectangular piece of cloth having a length equal to L'+D'+$L_f$ and a width equal to 2($W_f$)+(W'). As such, when transferring the template to the cloth, the foot end left and right corners of the starting cloth will have excess material 184*a*-*e*, 186*a*-*e* (and in the case of FIGS. 1*d*-1*e*, also excess material 185*d*-*e*, respectively) that will be cut away. The shape of the excess cut-away material can be substantially triangular, trapezoidal, or rectangular depending on the embodiment depicted. Although the numerous embodiments are depicted herein with substantially straight (linear) sides (e.g., 116, 118, 124, 126), non-linear sides could be employed, such as, curvilinear sides. In the case of FIGS. 1*a*, 1*c*, and 1*e*, the excess material 184*a*, 186*a* is substantially trapezoidal in shape. In FIGS. 1*b* and 1*e*, excess material 184*b*, 185*e* is substantially rectangular in shape. It will be understood to those of ordinary skill in the art that many variations on the precise fabric cuts can be employed to achieve the desired effect of having a partially fitted top sheet as in the present invention.

In the preferred embodiment of FIG. 1*b*, the left side expansion flap 103*b*, is of a substantially rectangular shape. Left side expansion flap 103*b* has a left side expansion flap outer edge 132*b* of length ($L_m$) that is substantially axial with pattern left flap edge 164. The head end side of the left side expansion flap 103*b* has a left side expansion flap top edge 148*b* of width ($W_f$) which is substantially parallel to left side flap bottom edge 156. Left side expansion flap top left corner 136*b* forms a substantially 90 degree angle at the intersection of left side expansion flap outer edge 132*b* with left side expansion flap top edge 148*b*. The width of left side expansion flap top edge 148*b* is equal to ($W_f$), the distance between left side expansion flap top left corner 136*b* and left side expansion flap top right corner 144*b* (the same point also referred to earlier as back face top left corner 144). The length ($L_m$) of left side expansion flap outer edge 132*b* extends between left side expansion flap top left corner 136*b* and left side expansion flap cut point 128*b*. Opposite left side expansion flap top edge 148*b* is left side expansion flap bottom edge 124*b*. Left side expansion flap bottom edge 124*b* has a length defined as the distance between left side expansion flap cut point 128*b* and left side expansion flap bottom right corner 120*b* (the same point also referred to earlier as back face bottom left corner 120). The distance of left side expansion flap fold line (or back face left side edge) 175*b* between left side expansion top right corner 144*b* and left side expansion flap bottom right corner 120*b* along fold line 176 is distance (D').

Referring still to FIG. 1*b* and similar to FIG. 1*a*, there is shown an underside flap 106*b* having an underside flap bottom edge 110*b* of width (W") (located opposite the head end edge 180) and parallel with foot end bottom edge 140. The underside flap 106*b* likewise contains left underside edge 116*b*. Forming the intersection of left underside edge 116*b* with the left end of underside flap bottom edge 110*b* at a substantially 90 degree underside flap bottom edge angle 111*b* is left corner 112*a*. Underside flap bottom edge 110*b* is substantially parallel to and separated by length ($L_f$) from foot end bottom edge 140. In the preferred embodiment depicted in FIG. 1*b*, underside flap 106*b* is a substantially rectangular shape and includes edges 110*b*, 140, and 116*b*. In this embodiment, underside flap left edge 116*b* has length equal to ($L_f$) as defined by the distance between underside edge left corner 112*b* and back face bottom left corner 120. In the embodiment of FIG. 1*b*, width (W")=width (W'). At the intersection of left underside edge 116*b* with left side expansion flap bottom edge 124*b* there is formed left expansion angle 170*b*. In the preferred embodiment of FIG. 1*b*, the left expansion angle is approximately 90 degrees. In a preferred embodiment, length ($L_m$) of left side expansion flap outer edge 132*b* is calculated to result in the length of left underside edge 116*b* and left side expansion flap bottom edges 124*b* being substantially equal. When the fitted top sheet is constructed from this pattern 100, the underside flap 106*b* will lay beneath the foot end of the mattress (M).

Similarly with FIG. 1*b*, in the preferred embodiment of FIG. 1*c*, the left side expansion flap 103*c* is of a substantially rectangular shape. Left side expansion flap 103*c* has a left side expansion flap outer edge 132*c* of length ($L_m$) that is substantially axial with pattern left flap edge 164. The head end side of the left side expansion flap 103*c* has a left side expansion flap top edge 148*c* of width ($W_f$) which is substantially parallel to left side flap bottom edge 156. Left side expansion flap top left corner 136*c* forms a substantially 90 degree angle at the intersection of left side expansion flap outer edge 132*c* with left side expansion flap top edge 148*c*. The width of left side expansion flap top edge 148*c* is equal to ($W_f$), the distance between left side expansion flap top left corner 136*c* and left side expansion flap top right corner 144*c* (the same point also referred to earlier as back face top left corner 144). The length ($L_m$) of left side expansion flap outer edge 132*c* extends between left side expansion flap top left corner 136*c* and left side expansion flap cut point 128*c*. Opposite left side expansion flap top edge 148*c* is left side expansion flap bottom edge 124*c*. Left side expansion flap bottom edge 124*c* has a length defined as the distance between left side expansion flap cut point 128*c* and left side expansion flap bottom right corner 120*c* (the same point also referred to earlier as back face bottom left corner 120). The distance of left side expansion flap fold line 175*c* between left side expansion top right corner 144*c* and left side expansion flap bottom right corner 120*c* along fold line 176 is distance (D').

Figure 1D:
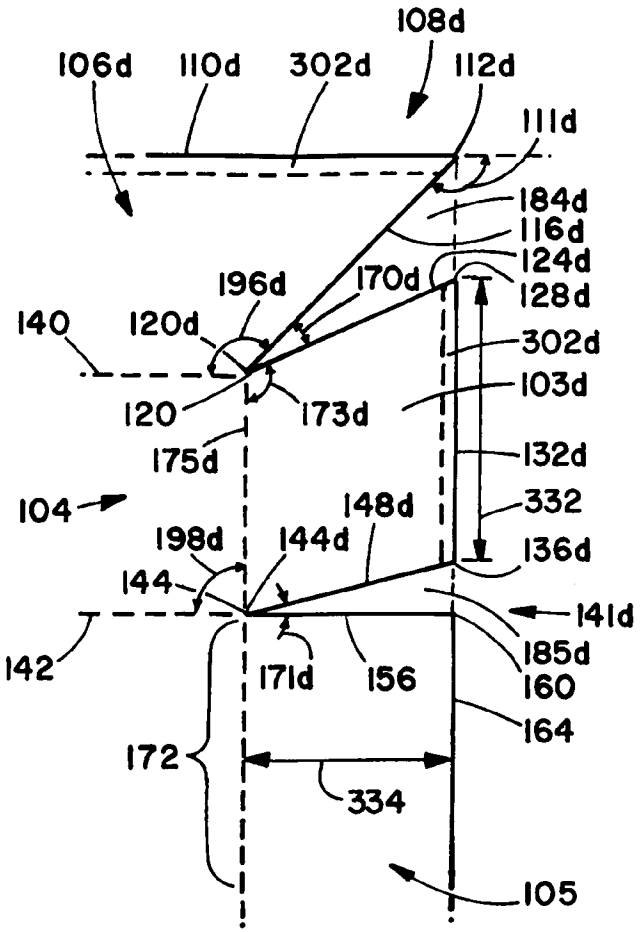
FIG. 1*d* shows a plan view of an alternative patterning to the cloth in the outlined area in FIG. 1*a* used for making a fitted top bed sheet according to another preferred embodiment of the present invention.

As a variation of the embodiment shown in FIG. 1*c*, referring to FIG. 1*d* there is shown another preferred embodiment of the pattern master 108*d* wherein the left side expansion flap 103*d* is of a substantially quadrilateral shape. In one preferred embodiment, the expansion flap 103*d* has the shape of a parallelogram, in another preferred embodiment, it has the shape of a trapezoid. Left side expansion flap 103*d* has a left side expansion flap outer edge 132*d* of length ($L_m$) that is substantially axial with pattern left flap edge 164. The head end side of the left side expansion flap 103*d* has a left side expansion flap top edge 148*d* of width ($W_d$) which is not parallel with left side flap bottom edge 156. Left side expansion flap top right corner 144*d* forms left side expansion flap top angle at the intersection of left side expansion flap seam line 175*d* with left side expansion flap top edge 148*d*. The length of left side expansion flap top edge 148*d* is equal to ($W_d$), the distance between left side expansion flap top left corner 136*d* and left side expansion flap top right corner 144*d* (the same point also referred to earlier as back face top left corner 144). The length ($L_m$) of left side expansion flap outer edge 132*d* extends between left side expansion flap top left corner 136*d* and left side expansion flap cut point 128*d*. Opposite left side expansion flap top edge 148*d* is left side expansion flap bottom edge 124*d*. Left side expansion flap bottom edge 124*d* has a length defined as the distance between left side expansion flap cut point 128*d* and left side expansion flap bottom right corner 120*d* (the same point also referred to earlier as back face bottom left corner 120). The distance between left side expansion top right corner 144*d* and left side expansion flap bottom right corner 120*d* along fold line 176 is distance (D'). Left side expansion flap bottom edge 124*d* forms a left side expansion flap top edge angle 173*d* of greater than 90 degrees relative to left side expansion flap fold line 175*d*.

Referring now to the preferred embodiments depicted in FIGS. 1*c*-1*e*, the respective underside flap 106*c*-106*e* is substantially in the shape of an isosceles trapezoid with the underside flap bottom edge 110*c*-110*e* being parallel to and having a width greater than the width of the foot end bottom edge 140, i.e., greater than width W'. The underside flap 106*c*-106*e* has an underside flap bottom edge 110*c*-110*e* of length (W") (located opposite the head end edge 180) and parallel with foot end bottom edge 140. The underside flap 106*c*-106*e* likewise contains left underside edge 116*c*-116*e* respectively. Forming the intersection of left underside edge 116*c*-116*e* with the left end of underside flap bottom edge 110*c*-110*e* at an underside flap bottom edge angle 111*c*-111*e* greater than 90 degrees is left corner 112*c*-112*e*. Underside flap bottom edge 110*c*-110*e* is substantially parallel to and separated by length ($L_f$) from foot end bottom edge 140. In these embodiments, underside flap left edge 116*c*-116*e* has length equal to the distance between underside edge left corner 112*c*-112*e* and back face bottom left corner 120. At the intersection of left underside edge 116*c*-116*e* with left side expansion flap bottom edge 124*b* there is formed left expansion angle 170*c*-170*d*, respectively.

In the preferred embodiments of FIGS. 1*c* and 1*d*, the left expansion angle 170*c*-170*d* is less than 90 degrees. Also, in the embodiment of FIG. 1*d*, the left side expansion flap bottom angle 173*d* formed by the intersection of left side expansion flap bottom edge 124*d* and left side expansion flap fold line 175*d* is greater than 90 degrees. In a preferred embodiment of FIG. 1*d*, the sum of the angles 170*d* and 173*d* is greater than 90 degrees. Also, in the embodiment of FIG. 1*d*, the left side expansion flap top angle 171*d* formed by the intersection of left side expansion flap top edge 148*d* and left side flap bottom edge 156 is greater than 90 degrees. In the preferred embodiments of FIG. 1*e*, the left expansion angle 170*e* is greater than 90 degrees. In a preferred embodiment, length ($L_m$) of left side expansion flap outer edge 132*c*-132*d* is calculated to result in the length of left underside edge 116*c*-116*d* and left side expansion flap top edges 124*c*-124*d* being substantially equal. When the fitted top sheet is constructed from this pattern 100, the underside flap 106*c*-106*e* will lay beneath the foot end of the mattress (M).

In FIG. 1*e*, there is no expansion flap 103 as in the other preferred embodiments. The left side flap 105*e* is of desired width ($W_f$) and contains a length 157*e* on its left side flap bottom edge 156*e* preferably corresponding in length to at least the length of the left edge 175*e* of back face 104.

In a preferred embodiment, the lengths of left side expansion flap bottom edges 124*a* (FIG. 1*a*), 124*b* (FIG. 1*b*), 124*c* (FIG. 1*c*), and 124*d* (FIG. 1*d*) are substantially equal to their respective corresponding underside flap left edges 116*a* (FIG. 1*a*), 116*b* (FIG. 1*b*), 116*c* (FIG. 1*c*), and 116*d* (FIG. 1*d*), respectively. In a preferred embodiment, the lengths of right side expansion flap top edges 126*a* (FIG. 1*a*), 126*b* (FIG. 1*b*), 126*c* (FIG. 1*c*), and 126*d* (FIG. 1*d*) are substantially equal to their respective corresponding underside flap right edges 118*a* (FIG. 1*a*), 118*b* (FIG. 1*b*), 118*c* (FIG. 1*c*), and 118*d* (FIG. 1*d*), respectively. As will be appreciated from the drawings and disclosure herein, the angles 170*a*-*e* and 168*a* can be varied, as can the edge lengths 116*a*-*e*, 124*a*-*e*, 118*a* and 126*a* to create the desired pattern for the foot end of the fitted top sheet. For example, where the length of edge 124*a* remains constant, the angle 170*a* could be varied along with the length of edge 116*a* until preferably, the length of edge 116*a* was equal to the length of edge 124*a*.

In a preferred embodiment, the angle 170*a*, 168*a* (FIG. 1*a*) remaining between left side expansion flap top edge 124*a* and underside flap left edge 116*a* is between 0-90 degrees, more preferably, between about 45-90 degrees. In another preferred embodiment, the angle 170*b* (FIG. 1*b*) remaining between left side expansion flap bottom edge 124*b* and underside flap left edge 116*b* is about 90 degrees. In another preferred embodiment, the angle 170*c* (FIG. 1*c*) remaining between left side expansion flap bottom edge 124*c* and underside flap left edge 116*c* is between 0-90 degrees more preferably, between about 45-90 degrees. In still another preferred embodiment, the angle 170*d* (FIG. 1*d*) remaining between left side expansion flap bottom edge 124*d* and underside flap left edge 116*d* is between 0-90 degrees more preferably, between about 45-90 degrees. The angle 171*d* (FIG. 1*d*) remaining between left side expansion flap top edge 148*d* and left side flap bottom edge 156 is between 0-45 degrees. In another preferred embodiment with respect to FIG. 1*d*, the angles 170*d* and 171*d* are set so that expansion flap edge 132*d* has the desired length $L_m$. As can be seen, other variations are possible. For example, the expansion flap edge 132, 134 length $L_m$ can be varied by varying the angles 170*a-d*, 111*a-e*, and/or 171*d*. Additionally, the expansion achieved in the embodiment of FIG. 1*e* can likewise be varied by adjusting the angles 170*e* and/or 111*e*. In a preferred embodiment of the present invention, expansion flap edge 132, 134 length $L_m \geqq (D')\times(1.25)$, where D' is the depth of the mattress (M). In a preferred embodiment, $L_m=(D')\times(1.25)$.

Figure 2:
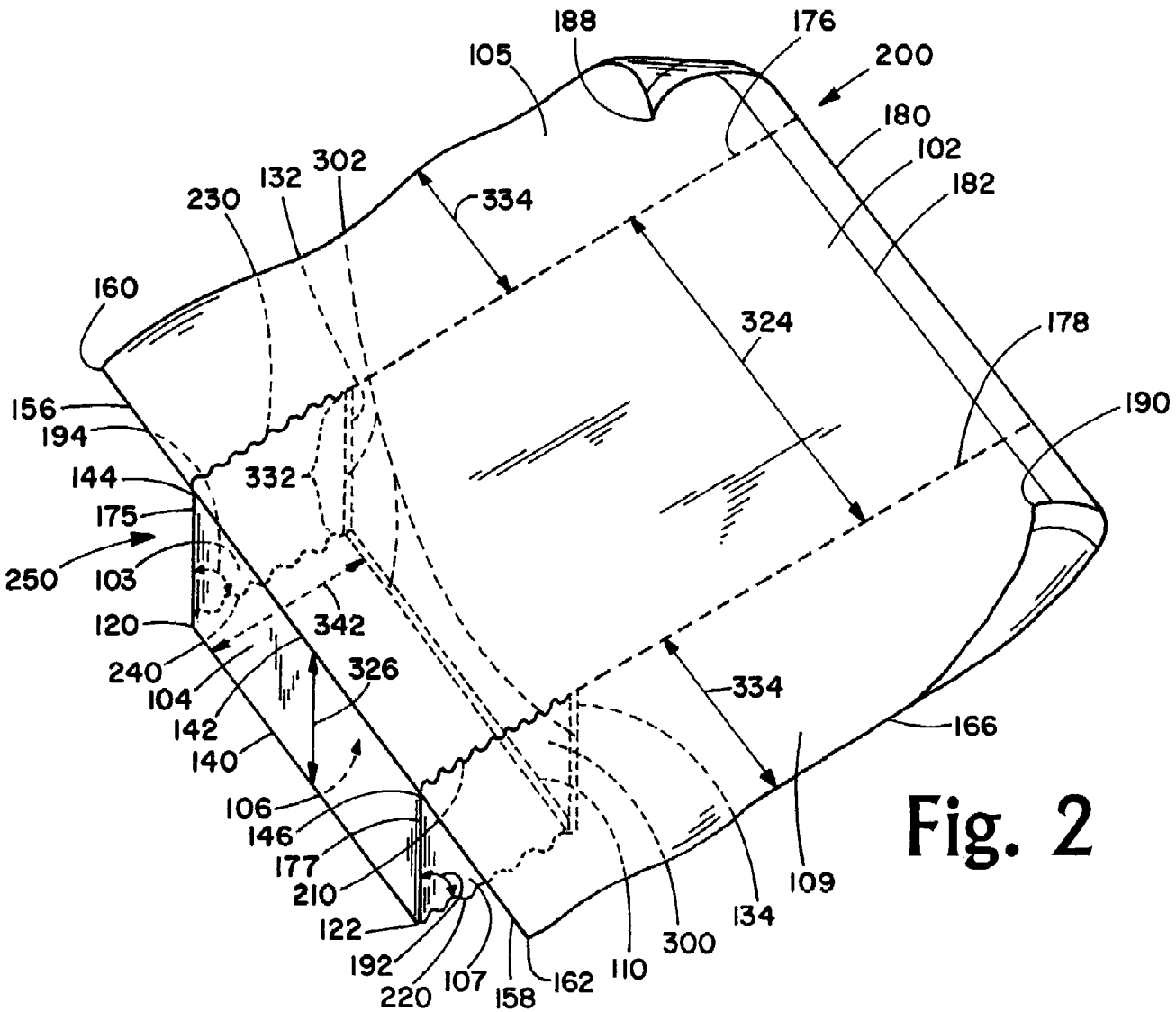
FIG. 2 shows a perspective view of a fitted top sheet according to a preferred embodiment of the present invention.

The fitted top sheets of the present invention can be constructed by transferring a pattern, such as that depicted in FIGS. 1*a*-1*e* to a single flat piece of fabric or to an existing flat top sheet to create a patterned sheet such as that shown in FIG. 2. Very few fabric cuts are required, and the sewing required is not complicated. As mentioned earlier, the pattern master zone 108*a* (as depicted in FIGS. 1*a*-1*e*) contains the pattern to be transferred, and such transfer can take place by using a pattern that has been created to depict one of the preferred patterns reflected in the pattern master zone of FIGS. 1*a*-1*e*.

A cut is made substantially perpendicular to the left flap edge 164 along left side cut line 141*a-d* between foot end left side flap left corner 160 and foot end left side flap right corner 152 along left side flap bottom edge 156 thereby separating the left side expansion flap 103*a*-103*d* from the left side flap 105 (and also in the case of FIG. 1*d*-1*e*, creating one of the cuts needed to remove excess material 185*e*-185*e*). In a preferred embodiment, left side cut line 141*a-e* has a length equal to the width ($W_f$) of left side flap 105. Similarly, in mirror image fashion to the treatment of the left side of the starting cloth, a cut is made substantially perpendicular to the right flap edge 166 cut along right side cut line 143*a*, etc. In a preferred embodiment, right side cut line 143*a* has a length equal to the width ($W_f$) of right side flap 109.

In the case of the embodiment depicted in FIG. 1*a*, additional cuts between points 112*a* and 120*a* (on the left side) and corresponding points 114*a* and 122*a* on the right side, as well as between points 128*a* and 120*a* on the left side (and the corresponding points 130*a* and 122*a* on the right side) complete the removal of excess material 184*a*, 186*a*. Similarly, in the case of the embodiment depicted in FIG. 1*b*, additional cuts between points 112*b* and 120*b* (on the left side) and the corresponding points on the right side, as well as between points 128*b* and 120*b* on the left side (and the corresponding points on the right side) complete the removal of excess material 184*b*. Likewise, in the case of the embodiment depicted in FIG. 1*c*, additional cuts between points 112*c* and 120*c* (on the left side) and the corresponding points on the right side, as well as between points 128*c* and 120*c* on the left side (and the corresponding points on the right side) complete the removal of excess material 184*c*. In the case of the embodiment depicted in FIG. 1*d*, an additional cut, between points 136*b* and 144*d* (and their mirror image on the right side) completes the removal of excess material 185*d*, and cuts between points 128*d* and 120*d*, as well as between points 112*d* and 120*d* (and their respective mirror images on the right side) completes the removal of excess material 184*d*. In the case of the embodiment depicted in FIG. 1*e*, additional cuts between points 112*e* and 120*e*, as well as, 120*e* and 144*e* (and the corresponding points on the right side) complete the removal of excess material 184*e*-185*e*.

Referring now to FIG. 2 in connection with FIGS. 1*a-d*, there is shown a preferred embodiment of fitted top sheet 200 constructed according to the present invention for creating a desired pattern for the foot end of the fitted top sheet. The numbering in FIG. 2 follows that of FIGS. 1*a*-1*d* but without reference to the letters, a, b, c or d. Referring again to FIGS. 1*a-d*, once the desired fabric has been patterned, the fitted top sheet can be constructed by sewing right side expansion flap top edge 150*a* to the underside of the fabric sheet along right side seam line 174 using conventional sewing techniques to create pocket right side upper seam 210. In a preferred embodiment, right side seam line 174 runs axially with the right side fold line 178 (but could deviate radially outward from right side fold line 178 (such rotation being pivoted about corner point 152). Additionally, the underside flap right edges 118*a-d* are sewn to their respective right side expansion flap bottom edges 126*a-d* to create pocket right side lower seam 220. If either of these edges does not match in length with the other, the length of the longer edge could be shortened by, e.g., folding in the corresponding outer edge. For example, if edge 126*a* is slightly longer than edge 118*a* then when sewing these two edges together, the extra length of edge 126*a* can be reduced by folding/tucking under outer edge 134*a*. Similarly, the left side expansion flap top edge 148 is sewn to the underside of the fabric sheet along left side seam line 172 using conventional sewing techniques to create pocket left side upper seam 230. In a preferred embodiment, left side seam line 172 runs axially with the left side fold line 176. Additionally, the underside flap left edges 116*a-d* are sewn to their respective left side expansion flap bottom edges 124*a-d* to create pocket left side lower seam 240. As will be apparent, the mirror images on the right side of the embodiments depicted in FIGS. 1*a-e* can be constructed as was done with the left side.

Referring now to FIG. 1*e*, once the desired fabric has been patterned, the fitted top sheet can be constructed by sewing the left edge 175*e* of back face 104 to length 157*e* on its left side flap bottom edge 156*e* using conventional sewing techniques. Additionally, the underside flap left edge 116*e* is sewn to the underside of the fabric sheet along left side seam line 172*e* using conventional sewing techniques.

During the sewing phase, in a preferred embodiment, an elastic-type material is sewn into the elastic zone 302*a-e*. The elastic can be sewn in using conventional techniques, such as by folding over the outer edges 132, 110 to create a seam pocket to hold (and hide from view) the elastic material without restricting the elastic's movement within the seam pocket. In another embodiment, the elastic material could be sewn directly onto or into the elastic zone 302*a-e*. Although the use of elastic is preferred, it is not required. As constructed, the fitted top sheet is now ready for use on the mattress size for which it was constructed. Referring still to FIG. 2, it will be understood that the left and right side flaps 105, 109, respectively, are shown in an undraped fashion for purposes of illustration. The fitted top sheet 200 when so constructed now has at its foot end, a five-sided, fitted expandable pocket 250 formed by left and right side expansion flaps 103, 107, back face 104, underside flap 106, and the foot end portion of the underside of top side face 102. The pocket 250 so created has a fitted end opening 300 capable of receiving the foot end of a mattress (M).

Although not as preferred as cutting and assembling the fitted top sheet 200 from a single piece of fabric or flat sheet, it would be possible to remove the left and right side expansion flaps 103*a-d*, 107*a-d* from the pattern and replace them with a separate piece of fabric, including for example, a stretchable, expandable fabric, such as spandex and the like. It would also be possible, but not as preferred, to construct the fitted top sheet out of a series of pieces that when sewn together comprises the present invention.

Figure 3:
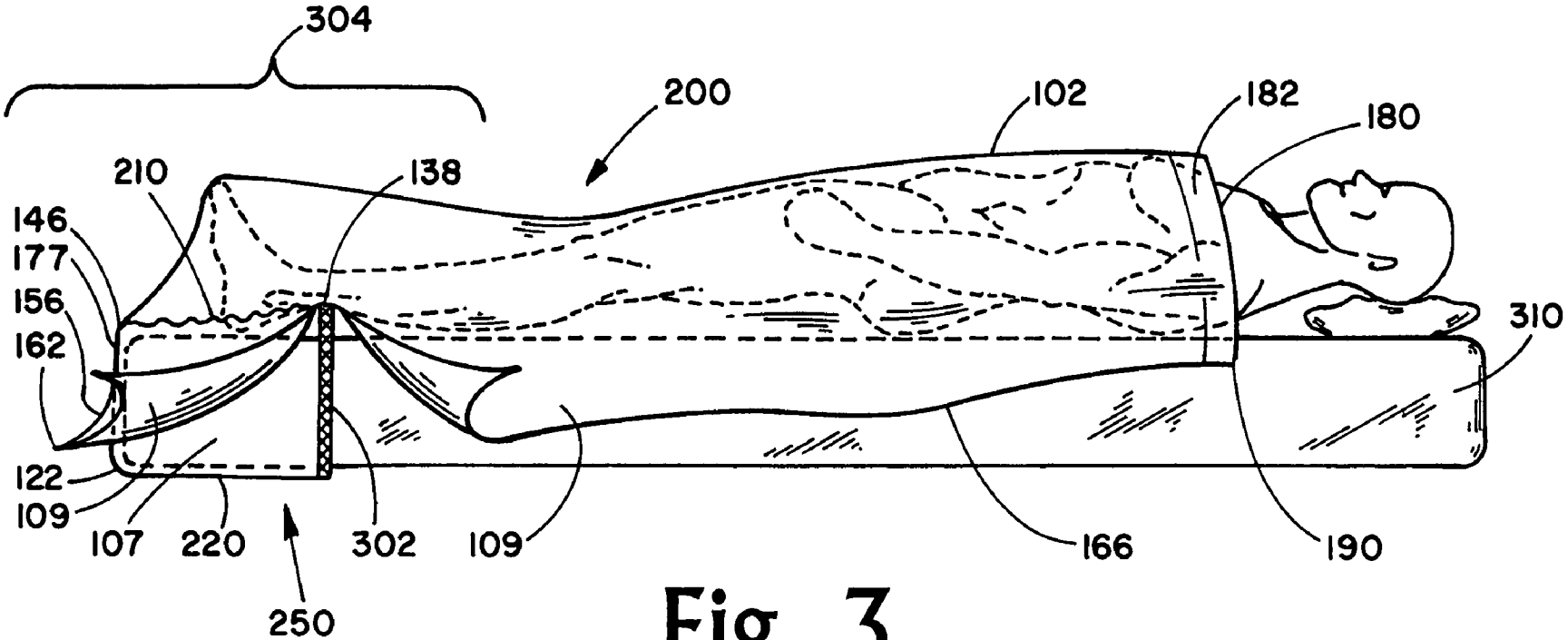
FIG. 3 shows a right side view, partially revealed, of a fitted top sheet covering a person on a mattress according to a preferred embodiment of the present invention.

Referring now to FIG. 3, there is shown a person lying on a mattress employing a fitted top sheet 200 made from a pattern according to a preferred embodiment of the present invention (e.g., FIGS. 1*a*-1*d*). In this FIG. 3, the right side flap 109 of the partially fitted top sheet 200 is in its draped position being draped over the side of the mattress from corner 146 to the head end of the mattress. In FIG. 3, right side flap 109 is shown in a partially cut-away view so that the expandable pocket 250 at the foot end of the mattress can be seen. The fitted top sheet 200 may be placed on a mattress (e.g., over the bottom sheet) by pulling the fitted end opening 300 over the foot end of the mattress (M). Once installed on a mattress (M), the fitted top sheet 200 will fit snugly over the foot end of the mattress with a tidy, square-cornered fit, and flaps 109, 105 that extend along the entire length of the mattress, will hang evenly on both sides of the mattress. In the embodiments of FIGS. 1*a*-*d*, the fitted top sheet preferably contains an elastic zone 302 that enables the fitted sheet to expand upward in the zone of expansion 304 in the location of the feet of the person allowing additional room for the feet without causing the sheet to become dislodged from under the mattress. The area where a sleeper's feet might lie is indicated by foot zone or zone of expansion 304. When feet are in the zone of expansion 304, the nature of the construction of the foot end of the fitted sheet 200 is such that the top face 102 of the sheet 200 has room to expand due to the various configurations of the expansion flap 107. The top face is permitted to move upwards proximate to the fitted end opening 300. Where elastic 302 is used, the elastic tension will assist in maintaining the sheet 200 in a flat position when feet are not in the zone of expansion 304.

As will be appreciated, for a rectangular-shaped mattress (M), the configuration of the pattern 100 along its left edge will be substantially the mirror image of the configuration of the pattern 100 along its right edge. As such, a pattern can easily be created to cut fabric for making a fitted top sheet according to preferred embodiments of the present invention. For example, in a preferred embodiment, a pattern master is created by isolating only one of the foot-end corners (pattern master zone 108*a*) and creating a generic pattern that can be used to identify the appropriate cuts to make, length of cuts, etc. This pattern master 108 can be placed onto one of the foot-end corners of the fabric to be cut, and then used in its mirror image on the opposite foot-end corner.

Although it is preferred to practice this invention by using a pattern to pattern a starting cloth or existing flat sheet, it will be apparent that one could create a fitted sheet having a pouch by separately creating a pouch and then attaching same to a flat cloth. However, this would add to the complexity of the sewing and add a larger number of sewn seams that could be subject to wear and tear—as such, it is preferred that the fitted top sheet of the present invention be constructed out of a unitary piece of fabric with a minimal amount of sewing.

The sheet 200 can be made from any of the conventional bed sheeting materials, for example, cotton, cotton percale, muslin, linen, silk, satin, etc. The sheet 200 is preferably sized in length to cover the upper surface of a mattress (M), and preferably made wide enough to overlap the edges of a mattress (M) so that the edge portions of the sheet can be tucked under a mattress, if desired, to hold the edge portions of the sheet in place. The inventive fitted sheet of the present invention can be easily made using automatic cutting, folding, and sewing equipment of the types conventionally used.

In use, the fitted sheet is typically used on top of the bottom sheets and since the fitted top sheet is preferably dimensioned in length to fit the associated mattress, the foot edges help the person making a bed to align and proportion the sheet to the mattress, thereby facilitating the making of the bed. With the use of the fitted blanket of the present invention, it will be possible to change or otherwise make a bed in a quick, time efficient manner while ending up with a finished look that is pleasing to the eye. In reference to the fitted top sheet displayed in FIG. 3, once the user has finished sleeping, making the bed is quite simple. One merely needs to pull the top sheet back toward the head end, adjust the head end of the flaps 105, 109 (adjusting one should automatically adjust the other), and fold back the head end at the hem 182, if desired. The flaps 105, 109 provide a nice finished look over the entire length of the side of bed while the use of the expandable pocket 250 eliminates the need to use special corner folding to create such finished look. Putting a fitted sheet of the present invention onto a mattress (e.g., over a bottom sheet) is equally straightforward and time saving by pulling the pocket 250 over the foot end of the mattress, and then pulling the remaining portion of the sheet toward the head end, adjusting the head end of the flaps 105, 109 (adjusting one should automatically adjust the other), and folding back the head end at the hem 182, if desired. The process can be repeated if other fitted bedclothes of the present invention are used, such as, a partially fitted blanket or comforter.

REFERENCES

The following represents an exemplary list of references.

U.S. Patent References

1. U.S. Pat. No. 6,108,836 to Keene, III
2. U.S. Pat. No. 5,375,274 to Cuneo
3. U.S. Pat. No. 4,045,831 to Clark
4. U.S. Pat. No. 5,177,821 to Kawtoski
5. U.S. Pat. No. 6,725,477 to Ciaglia et al.
6. U.S. Pat. No. 4,308,626 to Weiss
7. U.S. Pat. No. 5,165,128 to Honig
8. U.S. Patent Application No 20040200000 A1 to Harbin et al.

Other References

9. Double Dream® brand of bed sheets offered by Bedmaid Corporation the worldwide web through the website of Sheets2Love.com.

All references referred to herein are incorporated herein by reference. While the apparatus and methods of this invention have been described in terms of preferred embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art. While the apparatus and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A fitted bed covering comprising:

a. a fabric sheet, formed from a single patterned fabric cloth, having a head end edge and a foot end edge opposite said head end edge, a right side edge and a left side edge opposite said right side edge, said head end edge being separated from said foot end edge by a desired length (L), said left side edge being separated from said right side edge by a desired overall width (W), said sheet comprising a right side flap of length (L) and width ($W_f$), a left side flap of length (L) and width ($W_f$), and a top face of length (L) and width (W'), said top face being located between said right and left side flaps, said right and left side flaps having a desired width ($W_f$) defined as the desired overhang of the sheet over the side of a mattress to be covered with said fitted bed covering, said top face having a desired width (W') equal to the width of said mattress such that the sum of the widths (W'), ($W_f$) and ($W_f$) is equal to the overall width (W), said right side flap having a right flap edge formed by said fabric sheet right side edge and a right fold line opposite and substantially parallel to, and spaced by distance ($W_f$) from said right flap edge, said left side flap having a left flap edge formed by said fabric sheet left side edge and a left fold line opposite and substantially parallel to, and spaced by distance ($W_f$) from said left flap edge;

b. an expandable, five-sided pocket, formed from said patterned fabric cloth, located on the underside of said foot end of said fabric sheet for securing said sheet to said foot end of said mattress, said pocket comprising a back face, an underside flap, a right side expansion flap, a left side expansion flap, and a portion of said underside of said fabric sheet, said back face having a back face foot end top edge defined as the portion (W') of said width (W) of said fabric sheet foot end edge; a back face foot end bottom edge substantially parallel to, opposite and separated by depth (D') from said back face foot end top edge; a back face right edge of depth (D') and a back face left edge of depth (D') opposite and parallel to said back face right edge; said back face existing in a plane substantially perpendicular to said fabric sheet;

said depth (D') representing the depth of said mattress to be covered with said fitted bed covering;

said right side expansion flap having a right side expansion flap top edge fixably attached along its entire length to the underside of said fabric sheet along said right fold line parallel to and disposed from said sheet right side edge to create a pocket right side upper seam; a right side expansion flap bottom edge opposite said right side expansion flap top edge, a right side expansion flap left edge that is contiguous with said back face right edge, and a right side expansion flap outer edge opposite said right side expansion flap left edge;

said left side expansion flap having a left side expansion flap top edge fixably attached along its entire length to the underside of said fabric sheet along said left fold line parallel to and disposed from said sheet left side edge to create a pocket left side upper seam; a left side expansion flap bottom edge opposite said left side expansion flap top edge, a left side expansion flap right edge that is contiguous with said back face left edge, and a left side expansion flap outer edge opposite said left side expansion flap right edge;

said underside flap having an underside flap foot end edge contiguous with said back face foot end bottom edge; an underside flap head end edge opposite said underside flap foot end edge; an underside flap right side edge fixably attached along its entire length to said right side expansion flap bottom edge to create a pocket right side lower seam; and an underside flap left side edge fixably attached along its entire length to said left side expansion flap bottom edge to create a pocket left side lower seam;

said pocket having an opening capable of receiving the foot end of said mattress, said opening defined by said right side expansion flap right side outer edge, said left side expansion flap left side outer edge, said underside flap head end edge, and a portion of said underside of said fabric sheet opposite said underside flap head end edge;

the width (W) of said sheet, when placed on said mattress, being sufficient to drape over and substantially cover the sides of said mattress and to substantially cover said right side expansion flap and said left side expansion flap; and c. a zone of expansion created in said foot end of said sheet by increasing the size of said pocket opening relative to the size of said foot end of said mattress, said zone of expansion permitting upward movement of said sheet proximate said zone of expansion, when said sheet is secured to said mattress, to allow additional room for a sleeper's feet without causing said sheet to become dislodged from said mattress.

2. The fitted bed covering of claim 1 further comprising a zone for receiving elastic material wherein said receiving zone comprises said right side expansion flap outer edge, said left side expansion flap outer edge, and said underside flap head end edge, and wherein said elastic material is fixably attached to or contained within all or a part of said receiving zone, said elastic material creating elastic tension to assist in maintaining said sheet in a flat position when the sleeper's feet are not in said zone of expansion.

3. The fitted bed covering of claim 1 wherein the bed covering is a top sheet, blanket, quilt, bed spread or comforter.

4. The fitted bed covering of claim 1 wherein said right side expansion flap and said left side expansion flap are in the shape of a rectangle.

5. The fitted bed covering of claim 1 wherein said right side expansion flap outer edge is longer in length than said right side expansion flap left side edge such that said right side expansion flap is in the shape of a trapezoid, and wherein said left side expansion flap outer edge is longer in length than said left side expansion flap right side edge such that said left side expansion flap is in the shape of a trapezoid.

6. The fitted bed covering of claim 1 wherein said right side expansion flap and said left side expansion flap are in the shape of a parallelogram.

7. The fitted bed covering of claim 1 wherein said right side expansion flap left edge meets said right side expansion flap bottom edge at an angle greater than or equal to 90 degrees, and said left side expansion flap right edge meets said left side expansion flap bottom edge at an angle greater than or equal to 90 degrees.

8. The fitted bed covering of claim 1 wherein the length of said right side expansion flap right edge and said left side expansion flap left edge are equal to 1.25× depth (D').

9. The fitted bed covering of claim 1 wherein said underside flap head end edge is longer in length than said underside flap foot end edge such that said underside flap is in the shape of a trapezoid.

10. The fitted bed covering of claim 1 wherein said right side expansion flap top edge is fixably attached along its entire length to the underside of said fabric sheet along said right fold line parallel to and disposed from said sheet right side edge using conventional sewing techniques to create said pocket right side upper seam; wherein said left side expansion flap top edge is fixably attached along its entire length to the underside of said fabric sheet along said left fold line parallel to and disposed from said sheet left side edge using standard sewing techniques to create said pocket left side upper seam; wherein said underside flap right side edge is fixably attached along its entire length to said right side expansion flap bottom edge using conventional sewing techniques to create said pocket right side lower seam; and wherein said underside flap left side edge is fixably attached along its entire length to said left side expansion flap bottom edge using conventional sewing techniques to create said pocket left side lower seam.

* * * * *